United States Patent [19]

Pennington

[11] 4,058,150

[45] Nov. 15, 1977

[54] WOOD CUTTING APPARATUS

[76] Inventor: Charles A. Pennington, 2910 E. Virginia, Apt. 17, West Covina, Calif. 91791

[21] Appl. No.: 665,246

[22] Filed: Mar. 9, 1976

[51] Int. Cl.[2] ..... B27C 9/00

[52] U.S. Cl. ..... 144/1 R; 83/9; 144/136 R; 144/309 R; 144/323; 30/388

[58] Field of Search ..... 144/1 R, 2 R, 3 R, 3 K, 144/42, 43, 136 R, 193 R, 309 R, 323; 83/5, 49, 425.1, 102.1, 483, 613, 614, 9; 30/383, 388, 390, 391

[56] References Cited

U.S. PATENT DOCUMENTS

| | | | |
|---|---|---|---|
| 3,403,709 | 10/1968 | Retherford et al. | 83/483 X |
| 3,421,556 | 1/1969 | Clifford | 144/3 R |

*Primary Examiner*—Willie G. Abercrombie
*Assistant Examiner*—W. D. Bray
*Attorney, Agent, or Firm*—Allan R. Fowler

[57] ABSTRACT

A wood cutting or scarfing and wood sawing apparatus includes a power saw having a pair of mutually spaced scarfing blades positioned in advance of the saw blade and aligned with side edges thereof. The scarfing blades, spring urged into engagement with a wood article being cut, sever surface fibers of the article in the cutting path of the following saw blade. Because the surface fibers are previously cut by the scarfing blades, the saw blade, which may thus be of a conventional crosscut type, does not tear the surface and a clean, smooth edged cut is provided. The apparatus is particularly adapted to laminated wood articles, such as conventional hollow core doors and plywood panels and sheets, which are otherwise difficult and relatively time consuming to cut without splintering. To enable cutting of doors and large panels or sheets, a large article support structure and a saw guideway are provided.

15 Claims, 3 Drawing Figures

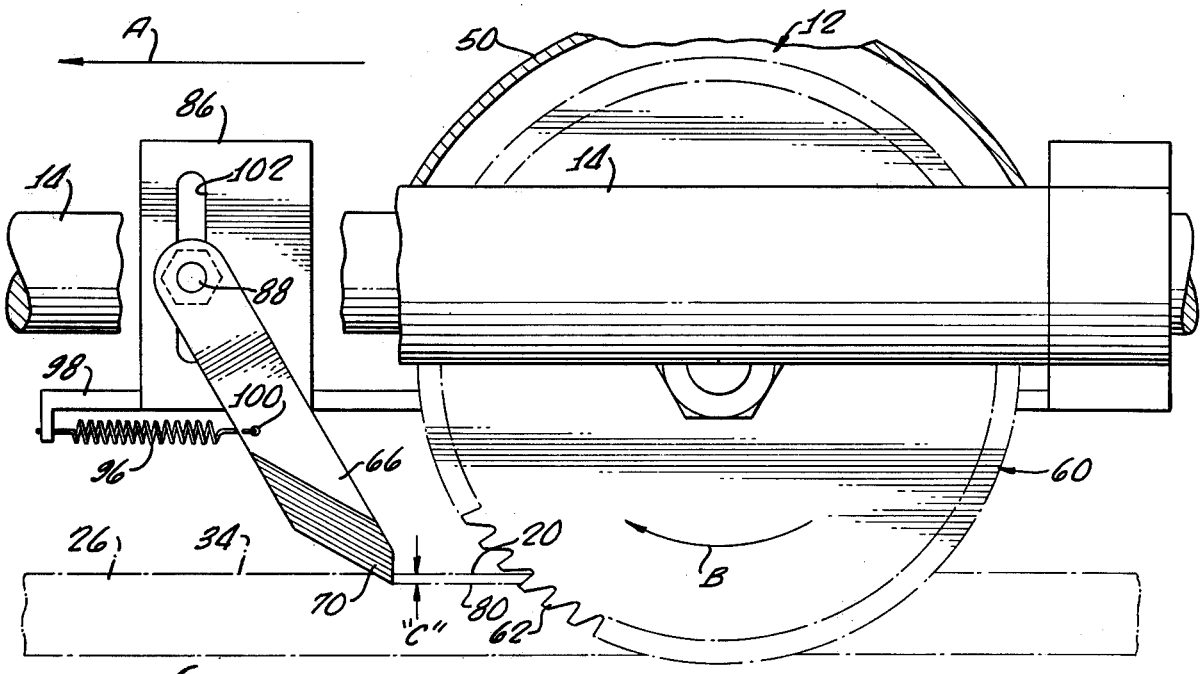
FIG. 2.
FIG. 3.
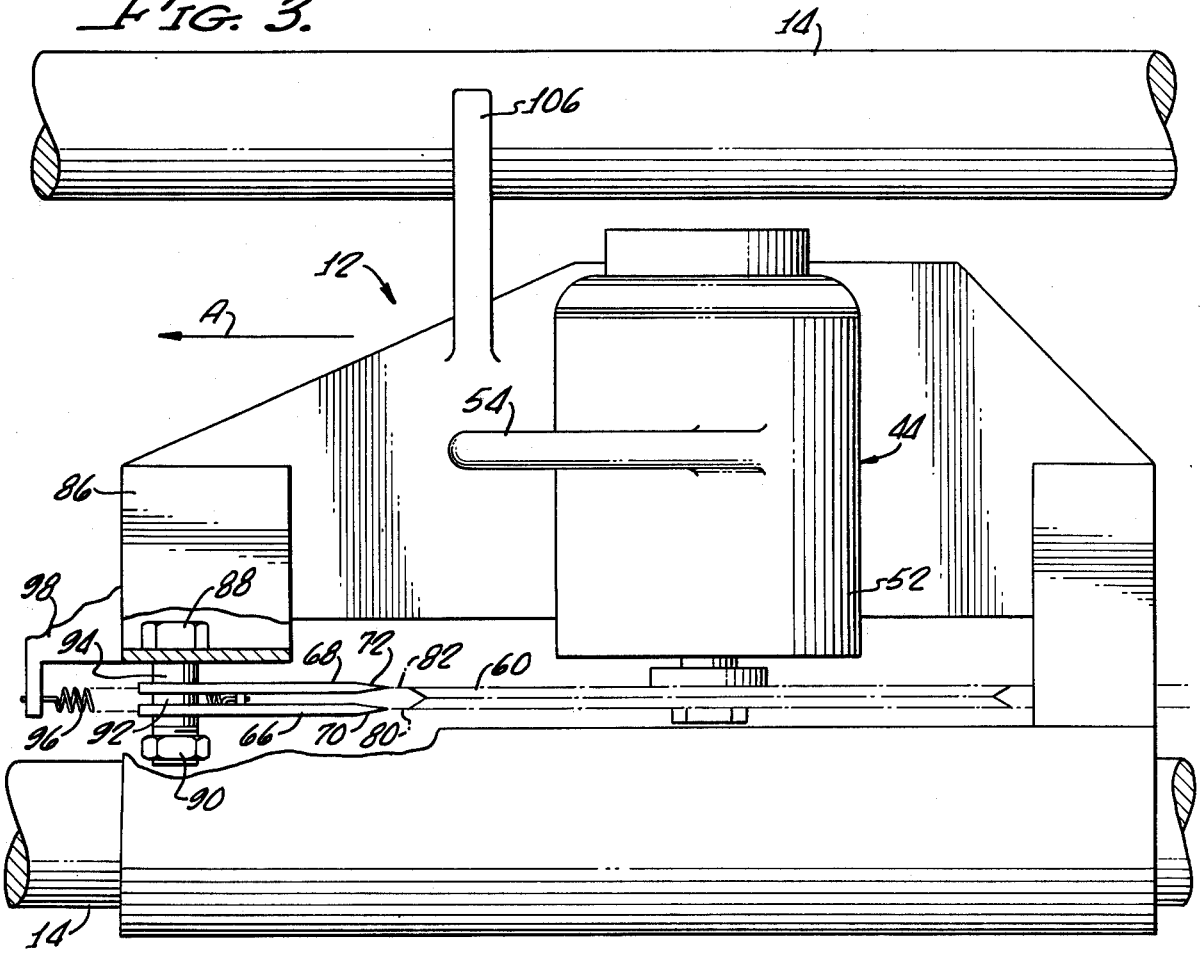

WOOD CUTTING APPARATUS

BACKGROUND OF THE INVENTION

1. Field of the Invention

This invention relates to apparatus for cutting wood, and in particular to apparatus for cutting laminated wood structures such as doors, paneling and plywood.

2. Discussion of the Prior Art

Often it is necessary to use power saws to cut wood in directions perpendicular or at large angles to the wood grain. Crosscut saw blades having a relatively few large teeth are especially designed for this purpose and provide rapid cutting. However, because of their configuration, crosscut blades tend to produce cuts having ragged and splintered surface edges. Such splintering and tearing of the surface wood is generally due to the surface layer or surface fibers of the wood having insufficient support or backing to withstand the cutting stresses. Thus, as the blade advances, the surface fibers are pushed upwardly and torn off, rather than being smoothly cut. This problem is particularly acute in thinly laminated materials, such as hollow core doors and plywood paneling, because the thin top layer of wood is only glued to the remaining composite structures; as a result, it tends to readily separate at the glued interface.

Various methods have been used to enable relatively clean, smooth cutting of wood laminates without tearing the surface fibers. For example, plywood-type saw blades are often used. These blades are typically hollow ground to minimize edge contact and have a large number of closely spaced teeth. Because the relatively small amount of wood cut by each tooth includes only a relatively small number of parallel surface fibers, the lifting action of the blade on the wood surface fibers is reduced, thereby reducing the extent of surface splintering. However, the splintering is not entirely eliminated. Because cutting action of such blades, due to their small bite, is slow, the cutting time for large panels and sheets of plywood is substantially increased over the time required using crosscut blades.

In addition, because plywood type blades are generally unavailable in high carbon steel, wear is relatively rapid and the blades are easily damaged when, for example, they encounter metal staples commonly used in constructing hollow core doors.

Ragged cut edges can, however, be eliminated if the surface fibers of the wood are cut prior to sawing the rest of the wood. Such cutting (or weakening) of surface fibers of wood is commonly called "scarfing." A typical method of scarfing heretofore used has been to manually mark the cut line and then cut or deeply indent the wood surface with a knife prior to making the cut with a power saw. However, this method is slow since the scarfing takes additional time and is a separate operation from the actual sawing. Also, because the scarfing is done separately, accurate, and often elaborate means are required to assure that the edge or edges of the saw blade cut will exactly coincide with the previously scarfed line or lines. Otherwise, not only will surface tearing still occur, but the scarfing lines may also be visable after the cut. This alignment is made even more difficult, and time consuming, when the cut is to be made blind, that is, with the scarfed lines facing a support table as is often necessary using fixed circle saws.

SUMMARY OF THE INVENTION

Wood cutting apparatus, in accordance with the invention, comprises a saw having a toothed blade with a motor coupled therewith, a scarfing knife blade having a cutting knife edge thereon, and means for supporting the scarfing blade at a position spaced in advance of the saw blade along the projected cutting path thereof with the cutting edge being disposed in alignment with or slightly outboard of one side of the saw blade. The scarfing blade is adapted for making a smooth, advance surface knife cut in a wood article being cut along one edge of the projected saw blade cut, thereby preventing splintering of the surface by the saw blade.

More specifically, the apparatus includes means for urging the scarfing blade cutting knife edge into cutting engagement with the article being cut. Means are also provided for selectively adjusting the height of the scarfing blade relative to the saw blade to accommodate the apparatus to different thicknesses of wood being cut.

A second scarfing blade may be added to provide a scarfing cut on wood to both sides of the projected path of the saw blade so that a smooth cut edge is provided on both sides of the saw blade.

In addition, a framework structure, having a substantially vertical table, may be provided for supporting wood articles to be cut. Associated with such framework are means for moving and guiding the saw relative to the table. The table has extensible article supporting arms projecting beyond the table in the plane thereof and means defining apertures for receiving projecting portions of wood articles, thereby enabling the articles to lay flat on the table.

Cutting of articles of the table is from top to bottom, means being provided to releasably retain the saw beneath the bottom of the table and a counterweight connected to the saw is provided.

By means of the apparatus, articles such as plywood sheets and hollow core doors may be easily and quickly cut in a single operation without splintering or tearing surface portions of the articles by the saw cutting action.

BRIEF DESCRIPTION OF THE DRAWINGS

A better understanding of the present invention may be had from a consideration of the following detail description taken in conjunction with the accompanying drawings, in which:

FIG. 2 is a side view of the power saw, along line 2—2 of FIG. 1, showing mounting of the scarfing blades; and, FIG. 3 is a partially broken away top view of the power saw, along line 3—3 of FIG. 2 showing alignment of the scarfing blades relative to the saw blade of the power saw.

DESCRIPTION OF THE PREFERRED EMBODIMENT

Figure 1:
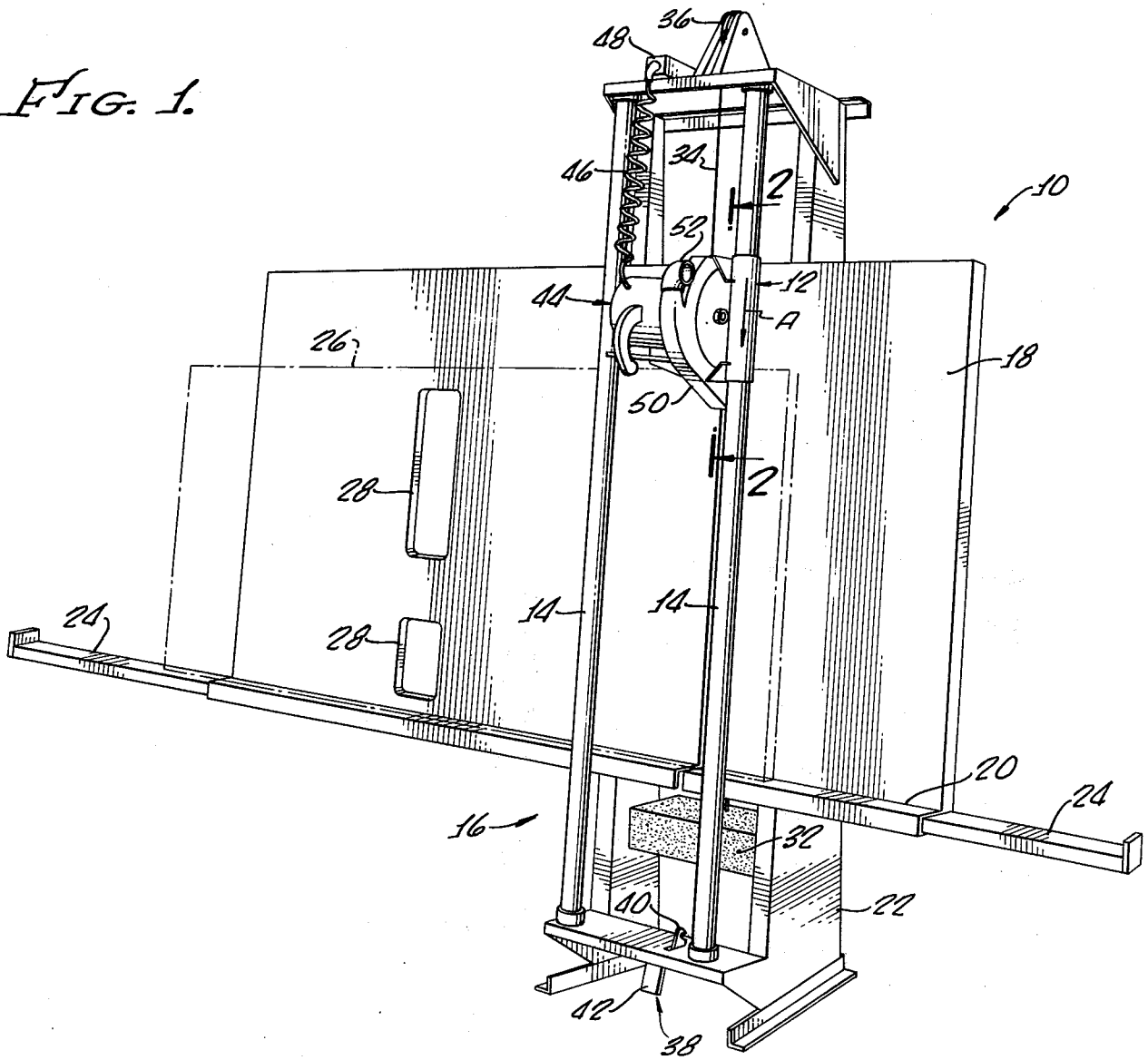
FIG. 1 is a perspective view showing a power saw which incorporates a pair of scarfing blades and showing a work supporting framework and saw guides.

As shown in FIG. 1, a wood cutting apparatus 10, particularly adapted for sawing plywood sheets and panels and trimming hollow core doors, comprises generally a power saw and scarfing tool 12, a pair of elongate tubular guideways 14 on which the tool is mounted, and an article or work-supporting structure 16. Included in the structure 16 is a large area work supporting table 18, having a lower supporting sill or flange 20, the table being mounted in a position slightly inclined from the verticle by a stand 22.

To accommodate long articles, the table 18 is preferably equipped with sill extensions 24. And, to accommodate protruding locks, handles, etc., of pre-assembled doors, such as a door 23 (shown in phantom lines), installed on the table 18 for trimming, cutouts 28 are provided in the table.

Fised between upper and lower portions of the stand 22, the guideways 14 are positioned orthogonally to the table sill 20 so that right angle cuts may be made on articles resting on the sill. The guideways 14 are also positioned so that the tool 12 passes over articles being cut so that it can easily be determined that the cut is following any pre-marked line. Stops (not shown) may, however, be provided in the region of the sill 20, for example, to enable articles to be cut to pre-selected lengths without marking.

Also included in the support structure 16 is a counterweight 32, connected to the tool 12 by a cable 34 which passes over a pulley 36 at the top of the stand 22. Cutting of articles on the table 18 is downwardly from top to bottom (Direction of Arrow "A"). Latch means 38, including a hook 40 and a foot release lever 42, are provided at the base of the stand 22 for maintaining the tool 12 in a bottom position, as is usually desirable until after a cut article is removed from the table 18. Release of the latch means 38, allows the counterweight 32 to pull the tool 12 back to the top, at which time another article to be cut is placed on the table 18.

The tool 12 includes a motor 44 which is electrically connected, by an extensible coiled electrical cord 46, to a junction box 48 at the top of the stand 22. A tool housing 52 is formed having a fitting 54 adapted for connecting to a sawdust evacuating system (not shown) and a handle 56 operative for manually controlling movement of the tool 12 during cutting operations.

More particularly seen in FIGS. 2 and 3, the tool 12, which may also be used separately from the guideways 14 and the work supporting structure 16, includes a saw blade 60 having a number of peripheral cutting teeth 62. The blade 60 is connected to the motor 44 for rotation in the direction of Arrow B (FIG. 2). Such rotation causes the blade 60, in a cutting region where the blade intersects the article 26 being cut, to be moving generally in the same direction as movement of the tool 12 (Arrow A) over the article.

Saw blade rotation in the direction of Arrow B is desirble because the blade tends to be forced away from the article 26, rather than drawn into it, as the tool 12 is advanced, and less cutting power is required. However, with this direction of blade rotation, as the tool 12 is advanced in a cutting direction (Arrow "A"), surface fibers or portions 64 of the article 26 tend to be lifted from the surface by the saw blade teeth 62.

Tearing of these surface portions 64, resulting in ragged cut edges, is, however, prevented by first and second scarfing blades 66 and 68 (FIG. 2), which are fixed to a portion of the housing 52 forwardly in advance of the saw blade 60. Knife edges 70 and 72 of the scarfing blades 66 and 68, respectively, are positioned to cut the surface fibers 64 along the projected path of the saw blade 60 before these fibers are contacted by the saw blade.

To be completely effective, the scarfing blade knife edges 70 and 72 are precisely positioned, relative to the saw blade 60, so that scarfed lines or knife cuts 80 and 82 made thereby (FIG. 3) will be exactly along opposite edges of the cut made by the following saw blade. If, for example, the scarfed lines 80 and 82 are inside of projected cut edges, they cannot prevent tearing of the surface fibers 64. If they are outside the projected edges, upon cutting by the saw blade 60, the surface fibers 64 may be torn back to the scarfed lines 80 and 82, leaving an unsightly line adjacent to the saw blade cut.

In addition, the scarfed cuts 80 and 82 must extend to a depth (Arrow "C", FIG. 2) below an article surface equal or greater than the thickness of the surface fibers normally torn or splintered by the saw blade 60.

Still further, the scarfing blades 66 and 68 must be sufficiently rigid and rigidly mounted to assure straight scarfed cuts 80 and 82 regardless of the direction of the surface structure or grain of the article 26, which may otherwise tend to cause the cutting edges 70 and 72 to wander.

To provide necessary adjustments, upper ends of the scarfing blades 66 and 70 are pivotally mounted to a housing portion 86 by a bolt 88 and nut 90. A spacer 93, positioned on the bolt 88 between the blades 66 and 70 maintains the blades in an appropriate, mutually spaced relationship. Another, shorter spacer 94, on the bolt 88 between the housing portion 86 and the second scarfing blade 68, provides exact scarfing blade alignment relative to cutting edges of the saw blade 60.

At least one tension spring 96, having one end connected to a housing portion 98 and the other end connected to a pin 100 which passes transversely through the scarfing blades 66 and 68 in a central region, urges or pushes the cutting edges 70 and 72 into engagement with the article surface 64. The cutting angle which the scarfing blade knife cutting edges 70 and 72 make with the article surface 64, as well as tension of the spring 96, determines to a large extent the depth of the scarfed cuts 80 and 82.

To enable adjustment of such cutting angles to accommodate to different types of wood being cut, to vary the depth of the scarfed cuts 80 and 82 or to accommodate articles of various thicknesses, the scarfing blade mounting bolt 88 passes through an elongate slotted aperture 102 in the housing portion 86. The cutting angle can thus be varied by moving the bolt 88 along the slot 102. Adjustment of tension in the spring 76, for example by changing springs or by other means not shown, also enables selective varying of the depth of the scarfed cuts 80 and 82. Stops (not shown) may be provided to limit pivotal movement of the scarfing blades 66 and 68. For most effective use, the scarfing blades 66 and 68 are preferably constructed from a high carbon steel and have relatively sharp tapered cutting points.

Trimming of exterior doors may require that cuts be made at angles of about 85 degrees, rather than 90°, to the plane of the door. To enable easy and rapid shifting for 85 and 90° cuts, a housing arm 106 (FIG. 3) which rides along the surface of the guideway 14 adjacent the motor 44 may, for example, be hinged and indexed (not shown). In addition, a separate biasing spring, similar to the spring 96, is then provided for each of the scarfing blades 66 and 68, the blades being mounted on the bolt 88 for independent pivotal motion.

In addition to being able to use the tool 12 separately from the rest of the apparatus 10, for portable use, a similar installation of the scarfing blades 66 and 68 may be made to substantially any time of wood cutting power saw, including fixed circular saws, other types of portable circle saws, band saws, scroll and jig saws. In some cases the scarfing blades 66 and 68 may be mounted directly to the housing of the power saw. In other cases, such for a band saw or fixed circle saw, it will be necessary to mount the blades to the platform or table upon which an article to be cut rests. In any event, the above described relationship between the scarfing blades 66 and 68 and the saw blade must be maintained.

Also, there are some applications in which the apparatus 10 (or other power saws with thich the scarfing blades 66 and 68 are employed) is used principally for trimming off portions which are to be then discarded. For such applications only a single scarfing blade, positioned to scarf a line on the portion of the article to be saved, is required.

Although there has been described above a particular arrangement of a wood cutting apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. Portable apparatus for cutting wood, said apparatus being movable over a workpiece as a unit, comprising, in combination:

a saw having a toothed blade and a motor coupled in operative relationship therewith;

a scarfing blade having a knife cutting edge thereon; and, means for supporting the scarfing blade at a position spaced in advance of the saw blade along the projected cutting path thereof, with the knife cutting edge being disposed approximately in alignment with one edge of the projected cut of the saw blade, whereby the scarfing blade is adapted for making a smooth advance knife surface cut in the wood along one edge of the projected cutting path of the saw blade.

2. The apparatus of claim 1, further including means adapted for urging the scarfing blade cutting edge into cutting engagement with wood being cut.

3. The apparatus of claim 1 further including means for selectively adjusting the height of the scarfing blade relative to the saw blade to thereby adapt to different thicknesses of wood being cut.

4. The apparatus of claim 1, wherein the saw blade is circular and the cutting edge of the scarfing blade is tapered.

5. Portable apparatus for cutting wood, said apparatus being movable over a workpiece as a unit, comprising, in combination:

a saw having a toothed blade and a motor coupled in operative relationship therewith;

two scarfing blades each having a knife cutting edge thereon; and, means for supporting the scarfing blades in an approximate parallel relationship at a position spaced in advance of the saw blade along the projected cutting path thereof with the knife cutting edge of one of the scarfing blades being disposed approximately in alignment with one edge of the projected cut of the saw blade, and with the knife cutting edge of the other scarfing blade being disposed approximately in alignment with another edge of the projected cut of the saw blade.

6. Apparatus for cutting wood comprising, in combination:

a framework adapted to support large sheets of wood;

a saw having a toothed blade and a motor coupled in operative relationship therewith;

means for selectively moving and guiding the saw relative to the frame;

a scarfing blade having a cutting edge thereon; and, means for supporting the scarfing blade at a position spaced in advance of the saw blade along the projected cutting path thereof, with the cutting edge being disposed approximately in alignment with one edge of the projected cut of the saw blade, whereby the scarfing blade is adapted for making a smooth advance surface cut in the wood along one edge of the projected cutting path of the saw blade.

7. The apparatus of claim 6, wherein the framework includes a substantially upright table for supporting wood to be cut and the means for moving and guiding the saw includes a guide bar disposed adjacent and parallel to one side of the saw blade along the projected cutting path thereof.

8. The apparatus of claim 7, wherein the means for moving and guiding the saw includes a second guide bar disposed parallel to the saw blade on a side thereof opposite to the first mentioned guide bar, said saw being operative to slide along the guide bars.

9. The apparatus of claim 7, wherein the table has a front and a back side and the means for moving and guiding the saw is operative for moving the saw over the front side of the table and includes a counterweight disposed to the back side of the table, said counterweight being connected to the saw by a flexible line passing over a top edge of the table.

10. The apparatus of claim 7, wherein the saw is operative to cut downwardly from a top edge to a bottom edge of the table.

11. The apparatus of claim 7, further including means for releasably engaging and holding the saw at a portion adjacent a lower edge of the table.

12. The apparatus of claim 7, wherein the table has extensible arms projecting in the plane of the table from each end and at the bottom thereof, said arms being adapted to support long wood sheets.

13. The apparatus of claim 7, wherein said table includes means defining at least one aperture adapted to receive projecting portions of an article placed upon the table, to thereby enable the article to lay flat against the table.

14. Apparatus for cutting wood, for use with a power saw having a toothed blade, comprising:

at least one scarfing blade having a cutting edge thereon;

means for mounting the scarfing blade to the power saw at a position spaced in advance of the saw blade along its projected cutting path, with the cutting edge of the scarfing blade being disposed approximately in alignment with one edge of the projected cut of the saw blade; and, means adapted for urging the cutting edge into cutting engagement with an article being cut by the saw.

15. The apparatus of claim 14 further including means for selectively adjusting the height of the scarfing blade relative to the saw blade to thereby adapt to different thickness of wood being cut.

* * * * *